US010609986B2

(12) United States Patent
Costa et al.

(10) Patent No.: US 10,609,986 B2
(45) Date of Patent: Apr. 7, 2020

(54) ARTICLES OF FOOTWEAR HAVING A LENO WOVEN UPPER WITH STRETCH ZONES

(71) Applicant: Reebok International Limited, London (GB)

(72) Inventors: Matthew J. Costa, Canton, MA (US); Thomas Piacentini, Waltham, MA (US); Dan Hobson, Waltham, MA (US)

(73) Assignee: Reebok International Limited, London (GB)

( * ) Notice: Subject to any disclaimer, the term of this patent is extended or adjusted under 35 U.S.C. 154(b) by 97 days.

(21) Appl. No.: 15/934,572

(22) Filed: Mar. 23, 2018

(65) Prior Publication Data

US 2019/0289962 A1 Sep. 26, 2019

(51) Int. Cl.

| | |
|---|---|
| ***A43B 1/04*** | (2006.01) |
| ***A43B 23/02*** | (2006.01) |
| ***A43B 23/04*** | (2006.01) |
| *A43B 13/02* | (2006.01) |
| *D03D 13/00* | (2006.01) |
| *D03D 19/00* | (2006.01) |

(52) U.S. Cl.

CPC ..... *A43B 23/0205* (2013.01); *A43B 23/04* (2013.01); *A43B 1/04* (2013.01); *A43B 13/02* (2013.01); *A43B 23/0275* (2013.01); *A43B 23/042* (2013.01); *D03D 13/006* (2013.01); *D03D 19/00* (2013.01)

(58) Field of Classification Search

CPC .. A43B 1/02; A43B 1/04; A43B 23/00; A43B 23/04; A43B 23/0205

USPC ..... 36/45, 47, 48, 9 R

See application file for complete search history.

(56) References Cited

U.S. PATENT DOCUMENTS

| | | | |
|---|---|---|---|
| 2,069,295 | A | 2/1937 | Wilson |
| 2,147,197 | A | 2/1939 | Glidden |
| 2,314,098 | A | 3/1943 | McDonald |
| 2,500,668 | A | 3/1950 | Duckoff |
| 3,524,792 | A | 8/1970 | Dawes |
| 3,822,727 | A | 7/1974 | Small et al. |
| 4,144,727 | A | 3/1979 | Duhl et al. |
| 4,736,531 | A | 4/1988 | Richard |
| 4,785,558 | A | 11/1988 | Shiomura |
| 5,131,434 | A | 7/1992 | Krummheuer et al. |

(Continued)

FOREIGN PATENT DOCUMENTS

| | | |
|---|---|---|
| CN | 101324001 | 7/2008 |
| CN | 103451769 | 12/2013 |

(Continued)

OTHER PUBLICATIONS

Shinn et, W.E. et al. "Leno Weaving and Design" Sep. 1930, 6 pages.

(Continued)

*Primary Examiner* — Marie D Bays
(74) *Attorney, Agent, or Firm* — Sterne, Kessler, Goldstein & Fox P.L.L.C.

(57) ABSTRACT

An article of footwear includes a sole and an upper. The upper includes a leno woven fabric having a continuous leno weave pattern of a plurality of warp yarns extending in a longitudinal direction and a plurality of weft yarns extending in a transverse direction. The leno woven fabric includes zones having different stretch characteristics.

20 Claims, 13 Drawing Sheets

(56) References Cited

U.S. PATENT DOCUMENTS

| | | | | |
|---|---|---|---|---|
| 5,187,005 | A | 2/1993 | Stahle et al. | |
| 5,345,638 | A * | 9/1994 | Nishida | A41H 3/08 12/146 C |
| 5,384,973 | A | 1/1995 | Lyden | |
| 5,484,646 | A | 1/1996 | Mann | |
| 5,562,967 | A | 10/1996 | Kikuchi et al. | |
| 6,004,891 | A | 12/1999 | Tuppin et al. | |
| 6,029,376 | A | 2/2000 | Cass | |
| D447,637 | S | 9/2001 | Lacy et al. | |
| 6,435,221 | B1 | 8/2002 | Waldrop et al. | |
| D477,918 | S | 8/2003 | Bruner et al. | |
| D477,919 | S | 8/2003 | Bruner et al. | |
| 6,684,911 | B2 | 2/2004 | Salway et al. | |
| 6,786,242 | B2 | 9/2004 | Salway et al. | |
| 6,931,762 | B1 | 8/2005 | Dua | |
| 7,047,668 | B2 | 5/2006 | Burris et al. | |
| 7,107,235 | B2 | 9/2006 | Lyden | |
| D531,817 | S | 11/2006 | Bruner et al. | |
| 7,166,349 | B2 | 1/2007 | Collins | |
| D557,509 | S | 12/2007 | Davis et al. | |
| 7,721,575 | B2 | 5/2010 | Yokoyama | |
| 7,766,053 | B2 | 8/2010 | Barratte | |
| 7,841,107 | B2 | 11/2010 | Braynock et al. | |
| 7,950,676 | B2 | 5/2011 | Goldsmith et al. | |
| D664,365 | S | 7/2012 | Whittle et al. | |
| D664,366 | S | 7/2012 | Whittle et al. | |
| D664,367 | S | 7/2012 | Whittle et al. | |
| D664,368 | S | 7/2012 | Davis | |
| 8,209,883 | B2 | 7/2012 | Lyden | |
| 8,375,471 | B2 | 2/2013 | Surve | |
| 8,839,824 | B2 | 9/2014 | Cross et al. | |
| 8,910,313 | B2 | 12/2014 | Gorden et al. | |
| 9,526,293 | B2 | 12/2016 | Bell et al. | |
| 9,756,901 | B2 | 9/2017 | Musho et al. | |
| 2003/0069807 | A1 | 4/2003 | Lyden | |
| 2003/0089000 | A1 | 5/2003 | Tseng | |
| 2003/0172983 | A1 | 9/2003 | Salway et al. | |
| 2004/0033337 | A1 | 2/2004 | Collins | |
| 2005/0116379 | A1 | 6/2005 | Goldsmith et al. | |
| 2009/0119948 | A1 | 5/2009 | Ortley et al. | |
| 2009/0291603 | A1 | 11/2009 | Newton et al. | |
| 2010/0223808 | A1 | 9/2010 | Sandy | |
| 2011/0119963 | A1 | 5/2011 | Braynock et al. | |
| 2011/0258881 | A1 | 10/2011 | Mateo | |
| 2011/0308115 | A1 | 12/2011 | Le et al. | |
| 2013/0025157 | A1 | 1/2013 | Wan et al. | |
| 2013/0048140 | A1 | 2/2013 | Yenici et al. | |
| 2013/0055590 | A1 | 3/2013 | Mokos | |
| 2013/0190917 | A1 | 7/2013 | Cross et al. | |
| 2014/0173932 | A1 | 6/2014 | Bell | |
| 2014/0173933 | A1 | 6/2014 | Bell | |
| 2014/0173934 | A1 | 6/2014 | Bell | |
| 2014/0189964 | A1 | 7/2014 | Wen et al. | |
| 2014/0259760 | A1 | 9/2014 | Dojan et al. | |
| 2014/0273700 | A1 | 9/2014 | Mouhassin et al. | |
| 2014/0310983 | A1 | 10/2014 | Tamm et al. | |
| 2014/0310984 | A1 | 10/2014 | Tamm et al. | |
| 2014/0338222 | A1 | 11/2014 | Song | |
| 2015/0013187 | A1 | 1/2015 | Taniguchi et al. | |
| 2015/0201707 | A1 | 7/2015 | Bruce | |
| 2015/0218737 | A1 | 8/2015 | Blakely | |
| 2016/0081417 | A1 | 3/2016 | Podhajny | |
| 2016/0095377 | A1 | 4/2016 | Tamm | |
| 2016/0309843 | A1 | 10/2016 | Song et al. | |
| 2017/0006965 | A1* | 1/2017 | Musho | A43B 7/06 |

FOREIGN PATENT DOCUMENTS

| | | | |
|---|---|---|---|
| CN | 203482955 | U | 3/2014 |
| DE | 10307489 | B3 | 11/2004 |
| DE | 102013214598 | A1 | 1/2015 |
| EP | 0600331 | A1 | 6/1994 |
| JP | H6113905 | | 4/1994 |
| KR | 10-1557130 | B1 | 9/2015 |
| TW | D122133 | | 4/2008 |
| TW | D125241 | | 10/2008 |
| TW | D138821 | | 2/2011 |
| TW | D141585 | | 7/2011 |
| TW | D141586 | | 7/2011 |
| WO | WO-96-000512 | | 1/1996 |
| WO | WO-98-043506 | | 3/1998 |
| WO | WO-2013-071679 | | 5/2013 |
| WO | WO-2013-103363 | | 7/2013 |
| WO | WO-2016171304 | A1 | 10/2016 |

OTHER PUBLICATIONS

U.S. Appl. No. 95/002,094, filed Aug. 21, 2012, Inventor: Robert Michael Lyden.

U.S. Appl. No. 15/787,178, filed Oct. 18, 2017, Inventors: Hobson et al.

* cited by examiner

ARTICLES OF FOOTWEAR HAVING A LENO WOVEN UPPER WITH STRETCH ZONES

FIELD

The described embodiments generally relate to articles of footwear having an upper including a leno woven fabric. More specifically, the described embodiments relate to articles of footwear having a leno woven upper with stretch zones.

BACKGROUND

Individuals are often concerned with the comfort and fit of an article of footwear. An upper of the article of footwear, which functions to secure the article of footwear to the wearer's foot, may contribute to the comfort and fit of the article of footwear. The article of footwear may be more comfortable and better fitting when different portions of the upper have different characteristics. Accordingly, a continuing need exists for innovations in footwear, including in the fabrics and other components used to manufacture an upper with different characteristics.

BRIEF SUMMARY

Articles of footwear with a leno woven upper with stretch zones are disclosed. In some embodiments, an article of footwear includes a sole and an upper. In some embodiments, the upper includes a leno woven fabric having a continuous leno weave pattern of a plurality of warp yarns extending in a longitudinal direction and a plurality of weft yarns extending in a transverse direction. In some embodiments, the leno woven fabric includes zones having different stretch characteristics.

In some embodiments, the leno woven fabric includes a low-stretch zone. In some embodiments, the low-stretch zone is disposed in a heel portion of the upper. In some embodiments, the leno woven fabric includes a high-stretch zone. In some embodiments, the high-stretch zone is disposed in a vamp portion of the upper.

In some embodiments, the leno woven fabric includes a low-stretch zone, an intermediate-stretch zone, and a high-stretch zone. In some embodiments, the intermediate-stretch zone is disposed in a quarter portion of the upper. In some embodiments, the intermediate-stretch zone is directly adjacent to the low-stretch zone. In some embodiments, the intermediate-stretch zone is directly adjacent to the high-stretch zone.

In some embodiments, the zones are joined together only by weaving the plurality of warp yarns and the plurality of weft yarns.

In some embodiments, an upper for an article of footwear includes a low-stretch zone of leno woven fabric, an intermediate-stretch zone of leno woven fabric, and a high-stretch zone of leno woven fabric. In some embodiments, the low-stretch zone, the intermediate-stretch zone, and the high-stretch zone are part of a single leno woven fabric formed by a continuous weaving pattern.

In some embodiments, the low-stretch zone provides no stretch. In some embodiments, the low-stretch zone comprises a reinforcing material that constrains the stretchability of the low-stretch zone. In some embodiments, the reinforcing material comprises a low-stretch plastic strand.

In some embodiments, a weaving pattern in the low-stretch zone differs from a weaving pattern in the high-stretch zone. In some embodiments, a material in the low-stretch zone differs from a material in the high-stretch zone.

In some embodiments, the single leno woven fabric forms an outer layer of the upper. In some embodiments, the single leno woven fabric forms an outer cover surrounding an inner portion of the upper. In some embodiments, the single leno woven fabric defines a plurality of apertures configured to receive laces. In some embodiments, a top portion of the single leno woven fabric is not attached to the inner portion of the upper.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
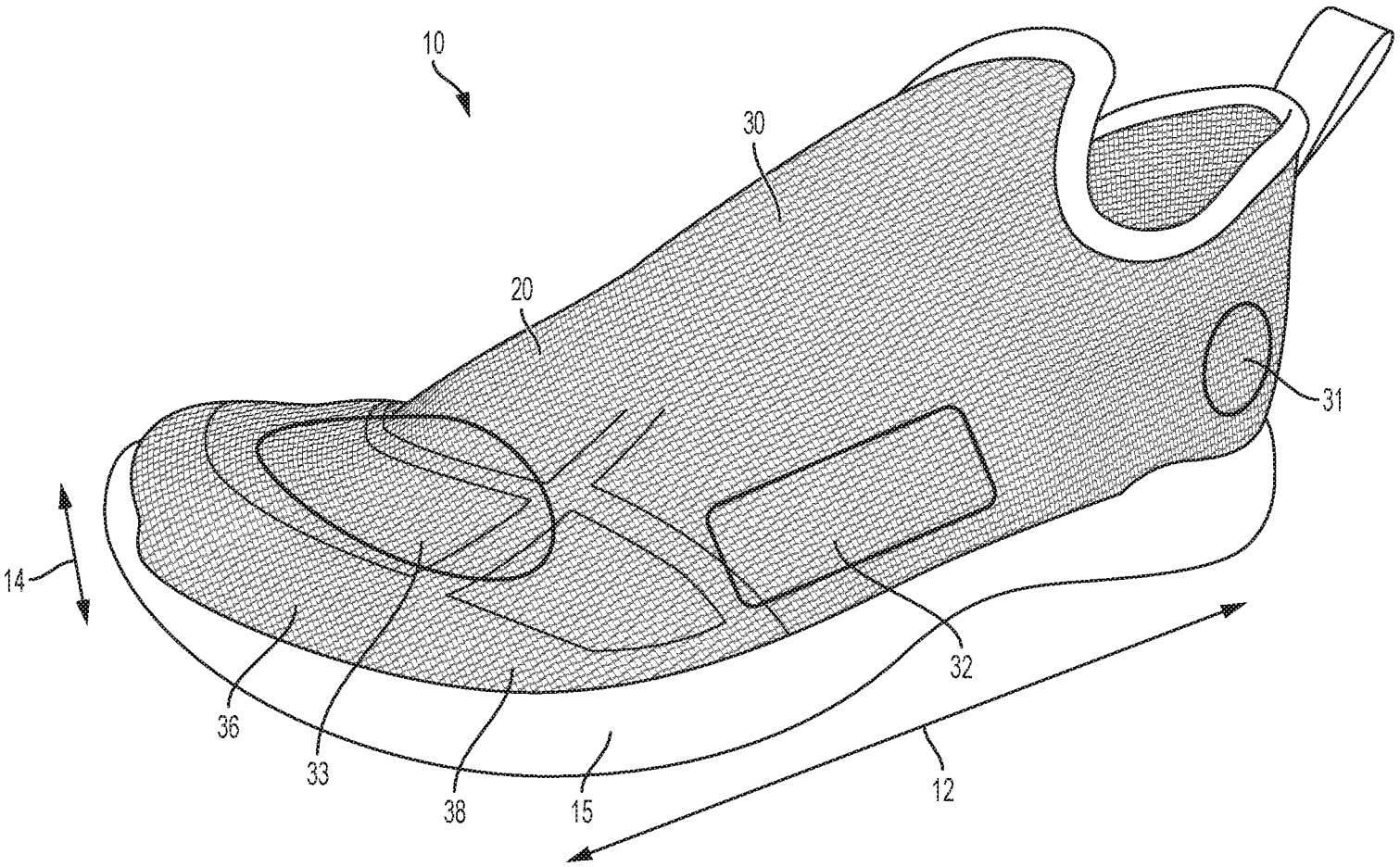
FIG. 1 shows an article of footwear according to some embodiments

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

An article of footwear has many purposes. Among other things, an article of footwear may serve to provide cushioning for a wearer's foot, support a wearer's foot, and protect a wearer's foot. Each of these purposes, alone or in combination, provides for a comfortable article of footwear suitable for use in a variety of scenarios (e.g., exercise and every day activities). The features of an article of footwear (e.g., shape and materials used to make footwear) may be altered to produce desired characteristics, for example, comfort and fit. The article of footwear may be more comfortable and better fitting when different portions of the upper have different characteristics, such as varying degrees of stretchability and/or varying degrees of softness.

In some embodiments, an article of footwear comprises a woven upper. In some embodiments, the upper is made of a leno woven fabric. In some embodiments, the upper may have one or more stretch zones. The stretch zones may have different degrees of stretchability. The use of leno woven fabric with stretch zones may increase the comfort and fit of the article of footwear. The different stretch zones offer different functionality by supporting and helping the foot through movement. In some cases, the level of stretch can help prevent injury.

In some embodiments, an article of footwear 10, as shown, for example, in FIG. 1, includes a sole 15 and an upper 20. In some embodiments, all or a portion of upper 20 may comprise a leno woven fabric 30. In some embodiments, leno woven fabric 30 comprises a continuous leno weave pattern. In some embodiments, leno woven fabric 30 comprises a single layer (i.e., a single layer of weft yarns 36 and warp yarns 38 in a leno weave configuration). In some embodiments, leno woven fabric 30 extends from the foremost part of upper 20 to the rearmost part of upper 20. Thus, leno woven fabric 30 may extend in a longitudinal direction 12 across the entire length of upper 20. In some embodiments, leno woven fabric 30 extends from sole 15 on a medial side of article of footwear 10 to sole 15 on a lateral side of article of footwear 10. Thus, leno woven fabric 30 may extend in a transverse direction 14 across the entire width of upper 20.

In some embodiments, leno woven fabric 30 may define at least 50% of upper 20. In embodiments including a single layer leno woven fabric 30, single layer woven fabric 30 may completely define at least 50% of upper 20. In other words, at least 50% of the composition of upper 20 may be defined by single layer leno woven fabric 30. In some embodiments, leno woven fabric 30 may occupy at least 50% of the outer surface area of upper 20.

In some embodiments, leno woven fabric 30 forms an outer surface of upper 20. In some embodiments, leno woven fabric 30 forms the entire outer surface of upper 20. In some embodiments, leno woven fabric 30 forms an inner surface of upper 20. In some embodiments, leno woven fabric 30 forms the entire inner surface of upper 20. In some embodiments, leno woven fabric 30 comprises an outermost layer of upper 20 and an innermost layer of upper 20. For example, in embodiments where leno woven fabric 30 is a single layer woven fabric, leno woven fabric 30 comprises a single layer that forms all or a portion of an exterior surface of upper 20 and all or a portion of an interior surface of upper 20. In some embodiments, leno woven fabric 30 includes more than one layer.

In some embodiments, leno woven fabric 30 comprises a plurality of warp yarns 38 extending in longitudinal direction 12 and a plurality of weft yarns 36 extending in a transverse direction 14 substantially perpendicular to warp yarns 38. As shown in FIG. 1, longitudinal direction 12 runs along the length of article of footwear 10 and transverse direction 14 runs along the width of article of footwear 10. In some embodiments, weft yarns 36 may extend in longitudinal direction 12 and warp yarns 38 may extend in transverse direction 14.

In some embodiments, one or more weft yarns 36 extend across the entire width of upper 20. In some embodiments, one or more weft yarns 36 extend from sole 15 on the medial side of article of footwear 10 to sole 15 on the lateral side of article of footwear 10. In some embodiments, one or more weft yarns 36 extend from sole 15 on the medial side of article of footwear 10 to the collar of article of footwear 10. In some embodiments, one or more weft yarns 36 extend from sole 15 on the lateral side of article of footwear 10 to the collar of article of footwear 10.

In some embodiments, one or more warp yarns 38 extend across the entire length of upper 20. In some embodiments, one or more warp yarns 38 extend from sole 15 to the collar of article of footwear 10 in longitudinal direction 12. In some embodiments, one or more warp yarns 38 extend from sole 15 to a heel counter of article of footwear 10 in longitudinal direction 12. In some embodiments, one or more warp yarns 38 extend from the foremost part of upper 20 to the collar of article of footwear 10 (e.g., along a throat region of upper 20). Thus, in some embodiments, leno woven fabric 30 may have a continuous leno weave pattern of weft yarns 36 and warp yarns 38.

In some embodiments, leno woven fabric 30 comprises a stretch leno weave (i.e., a leno woven fabric that has stretch characteristics). In some embodiments, leno woven fabric 30 comprises a two-way stretch material. In some embodiments, leno woven fabric 30 provides a desired stretchability because of the weaving pattern. In some embodiments, leno woven fabric 30 provides a desired stretchability because of the material of weft yarns 36 and/or warp yarns 38. In some embodiments, leno woven fabric 30 provides a desired stretchability because of a combination of the weaving pattern and the material of weft yarns 36 and/or warp yarns 38. In some embodiments, weft yarns 36 comprise an elastic material. In some embodiments, weft yarns 36 comprise spandex. In some embodiments, weft yarns 36 comprise spandex with polyester. In some embodiments, weft yarns 36 comprise a thermoplastic elastomer. In some embodiments, weft yarns 36 comprise a material that provides little to no stretch.

Figure 3:
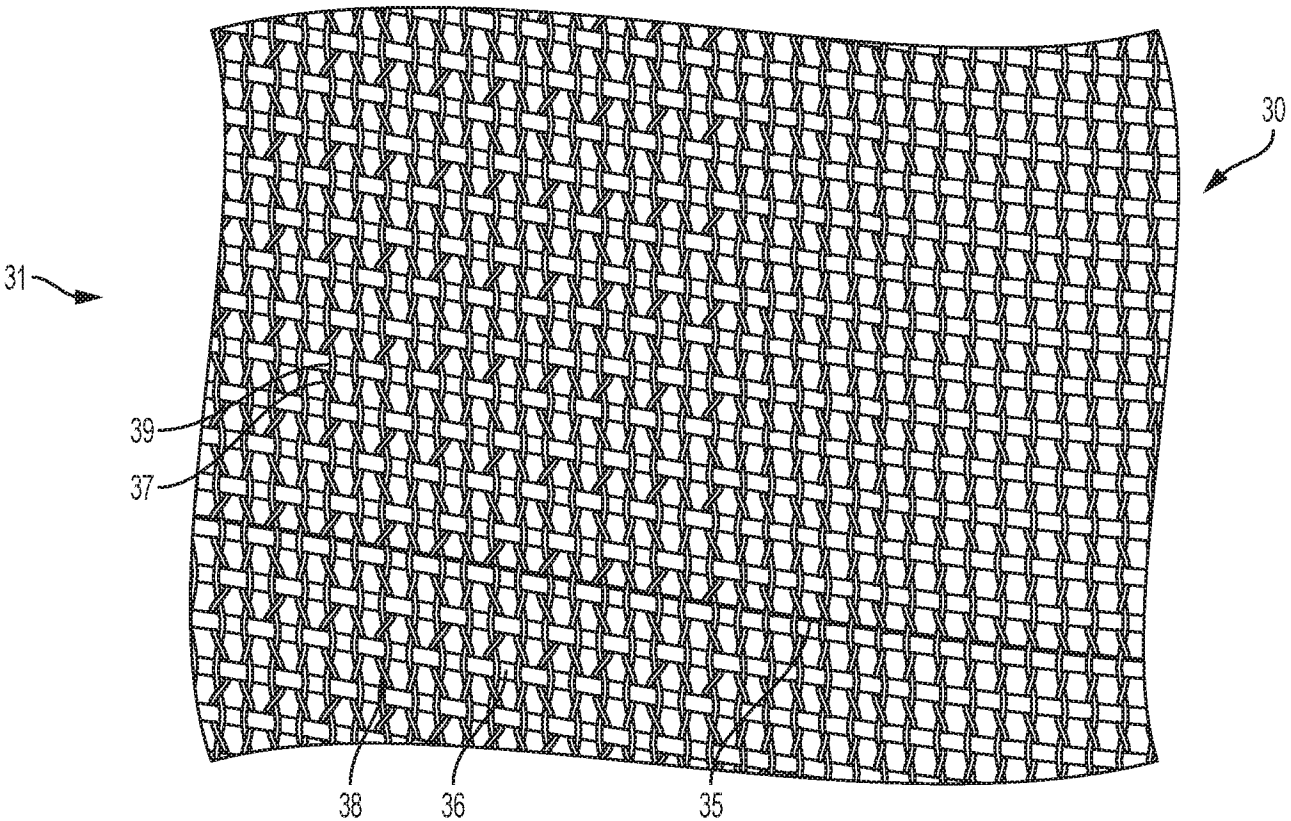
FIG. 3 shows a low-stretch zone for an article of footwear according to some embodiments.
Figure 4:
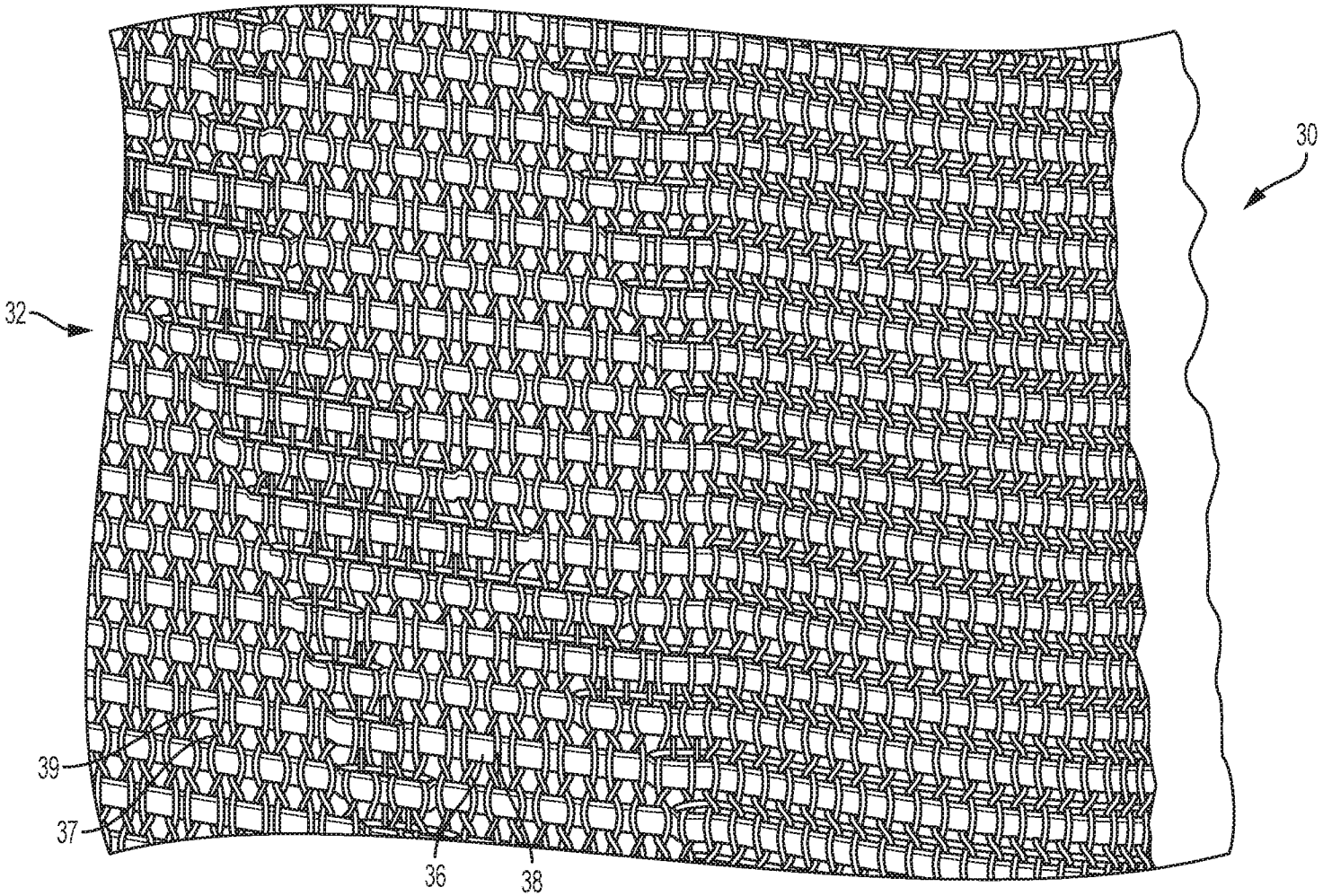
FIG. 4 shows a medium-stretch zone for an article of footwear according to some embodiments.
Figure 5:
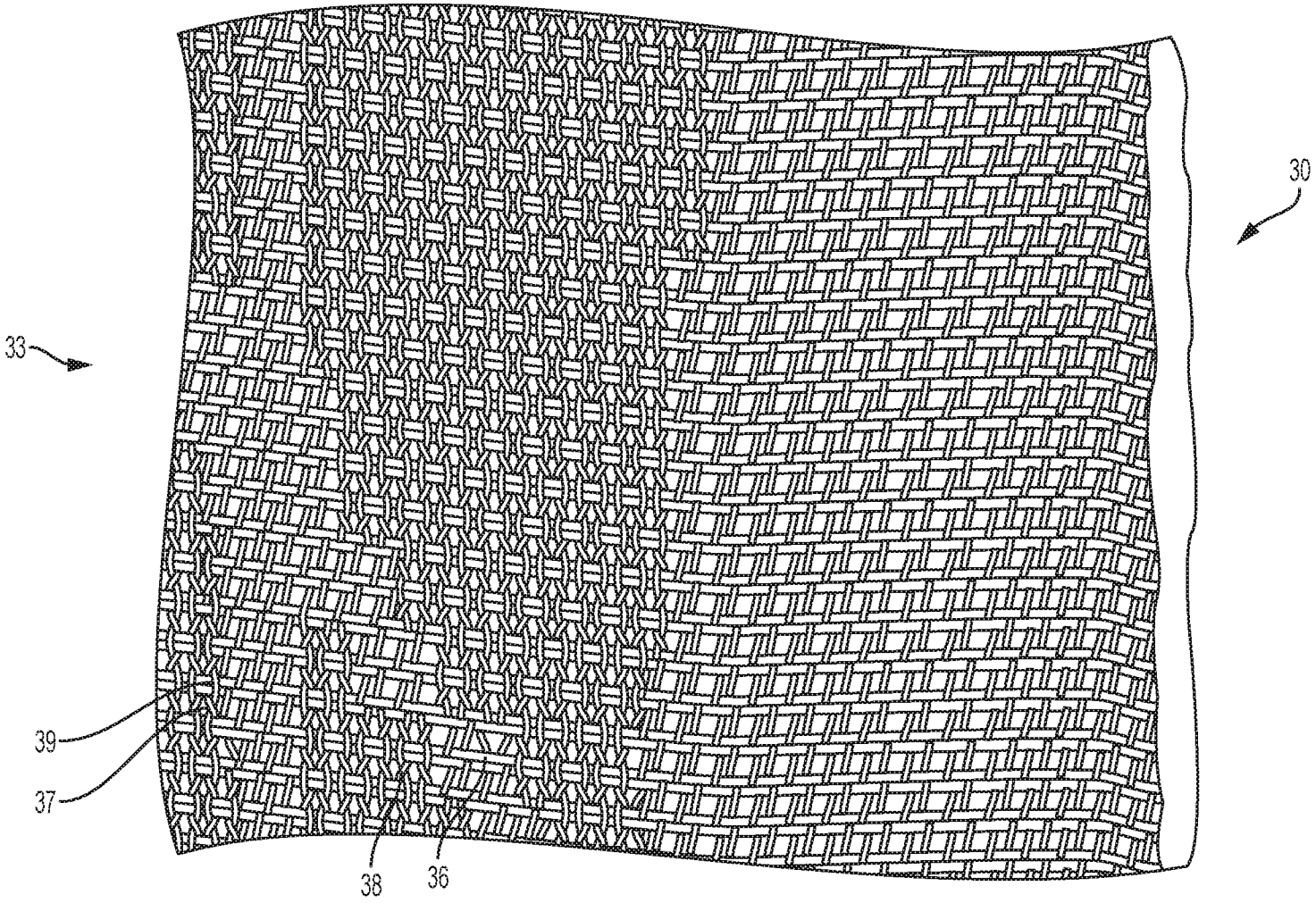
FIG. 5 shows a high-stretch zone for an article of footwear according to some embodiments.

The weaving of warp yarns 38 in leno woven fabric 30 may form a plurality of twists 37 and a plurality of eyelets 39, as shown, for example, in FIGS. 3-5. One or more weft yarns 36 may pass through eyelets 39 to form a leno weave configuration having a pattern. Twists 37 separate weft yarns 36 (or a plurality of weft yarns 36) in leno woven fabric 30. The location and configuration of twists 37 and eyelets 39 may influence the pattern of leno woven fabric 30, which may influence one or more characteristics of leno woven fabric 30. The number of weft yarns 36 woven through eyelets 39 at different locations on upper 20 may be employed to vary the pattern of leno woven fabric 30 and therefore the characteristics of leno woven fabric 30 at different locations on upper 20.

In some embodiments, leno woven fabric 30 comprises zones that have different characteristics from one another. In some embodiments, leno woven fabric 30 comprises stretch zones that have different levels of stretchability. For example, leno woven fabric 30 may comprise one or more low-stretch zones 31, one or more intermediate-stretch zones 32, and/or one or more high-stretch zones 33, as shown, for example, in FIG. 1.

In some embodiments, leno woven fabric 30 comprises a low-stretch zone 31 in a heel portion of upper 20. In some embodiments, leno woven fabric 30 comprises an intermediate-stretch zone 32 in a quarter portion of upper 20 (e.g., on the side of upper 20). The quarter is the portion of upper 20 that covers the sides of the wearer's foot. In some embodiments, leno woven fabric 30 comprises a high-stretch zone 33 in a vamp portion of upper 20. The vamp is the portion of upper 20 that covers the forepart of the wearer's foot. Other zones may be included in various portions of upper 20.

Figure 2:
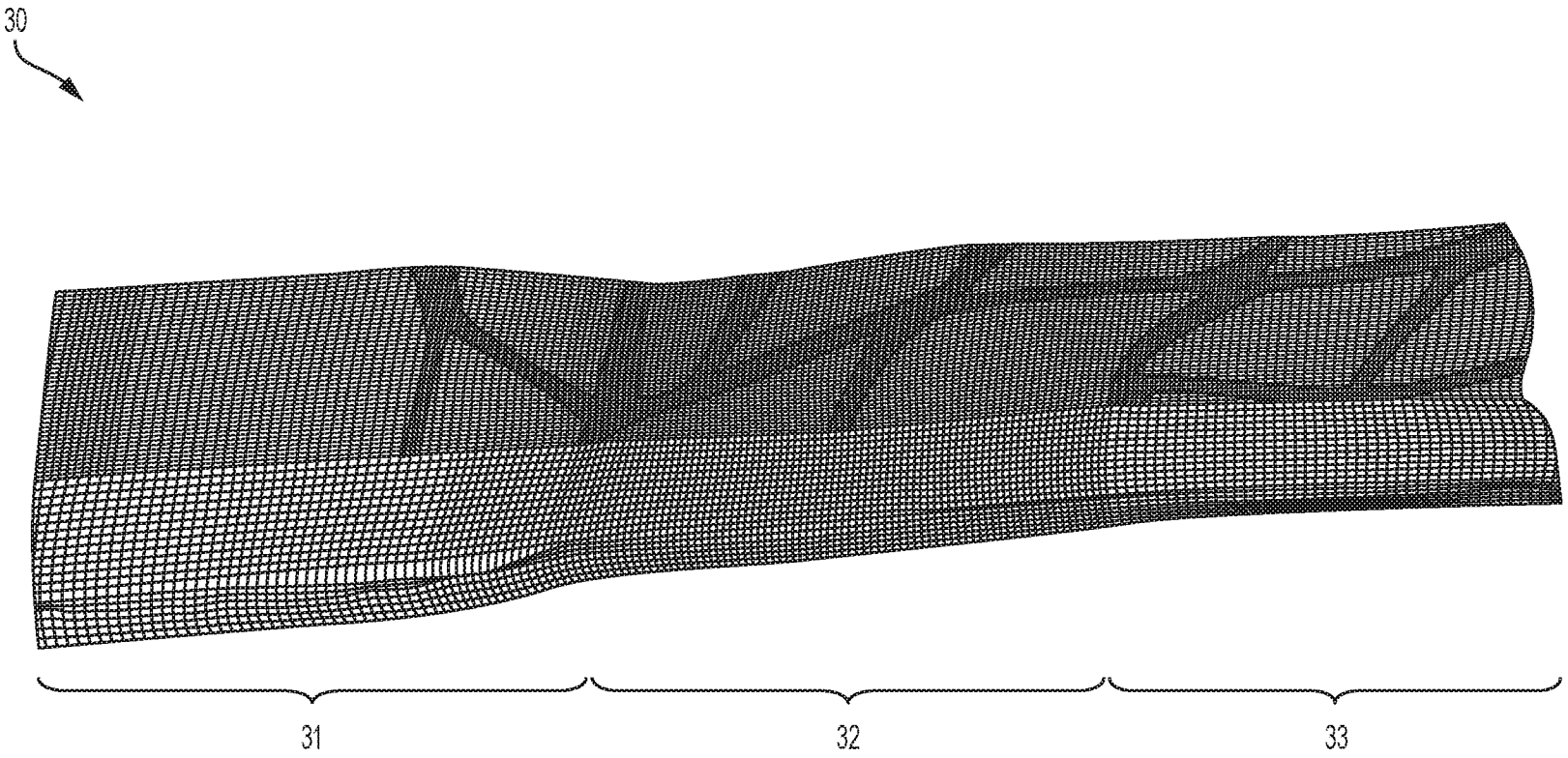
FIG. 2 shows stretch zones for an article of footwear according to some embodiments.

In some embodiments, leno woven fabric 30 comprises zones that have more than three levels of stretchability. For example, leno woven fabric 30 may include a zone that can stretch more than low-stretch zone 31, but less than intermediate-stretch zone 32. Additional levels of stretchability are also possible. In some embodiments, zones 31, 32, and 33 may be spaced from each other. In some embodiments, zones 31, 32, and 33 are directly adjacent to each other, as shown, for example, in FIG. 2. Thus, zone 31 may be directly adjacent to zone 32, which may be directly adjacent to zone 33. In some embodiments, the various zones 31, 32, and 33 are formed by a continuous weaving pattern. That is, the zones 31, 32, and 33 are joined together only by weaving weft yarns 36 and warp yarns 38 and are not joined together by other means, such as sewing, an adhesive, etc. (See FIG. 2.)

In some embodiments, low-stretch zone 31, as shown, for example, in FIG. 3, is configured to stretch less than intermediate-stretch zone 21 and high-stretch zone 33. In some embodiments, low-stretch zone 31 provides no stretch. In some embodiments, the material of weft yarns 36 and/or warp yarns 38 in low-stretch zone 31 comprise a material that provides little to no stretch. In some embodiments, a reinforcing material 35 is included in low-stretch zone 31 to constrain the stretchability of low-stretch zone 31. For example, a low-stretch plastic strand (i.e., reinforcing material 35) may be woven, along with weft yarns 36, into warp yarns 38. In some embodiments, the weaving pattern or manner of weaving may affect the stretchability of a particular zone. For example, weft yarn 36 may be stretched prior to weaving so that the resulting leno woven fabric 30 may not stretch further (i.e., a low-stretch zone 31).

In some embodiments, intermediate-stretch zone 32, as shown, for example, in FIG. 4, is configured to stretch more than low-stretch zone 31 and less than high-stretch zone 33. In some embodiments, the material of weft yarns 36 and/or warp yarns 38 in intermediate-stretch zone 32 comprise a material that provides intermediate stretch. In some embodiments, the weaving pattern or manner of weaving may affect the stretchability of a particular zone. For example, weft yarn 36 may be partially stretched prior to weaving so that the resulting leno woven fabric 30 may stretch further (i.e., an intermediate-stretch zone 32).

In some embodiments, high-stretch zone 33, as shown, for example, in FIG. 5, is configured to stretch more than low-stretch zone 31 and intermediate-stretch zone 32. In some embodiments, the material of weft yarns 36 and/or warp yarns 38 in high-stretch zone 32 comprise a material that provides high stretch. In some embodiments, the weaving pattern or manner of weaving may affect the stretchability of a particular zone. For example, weft yarn 36 may be unstretched prior to weaving so that the resulting leno woven fabric 30 may stretch to its full capacity (i.e., a high-stretch zone 32).

Figure 6:
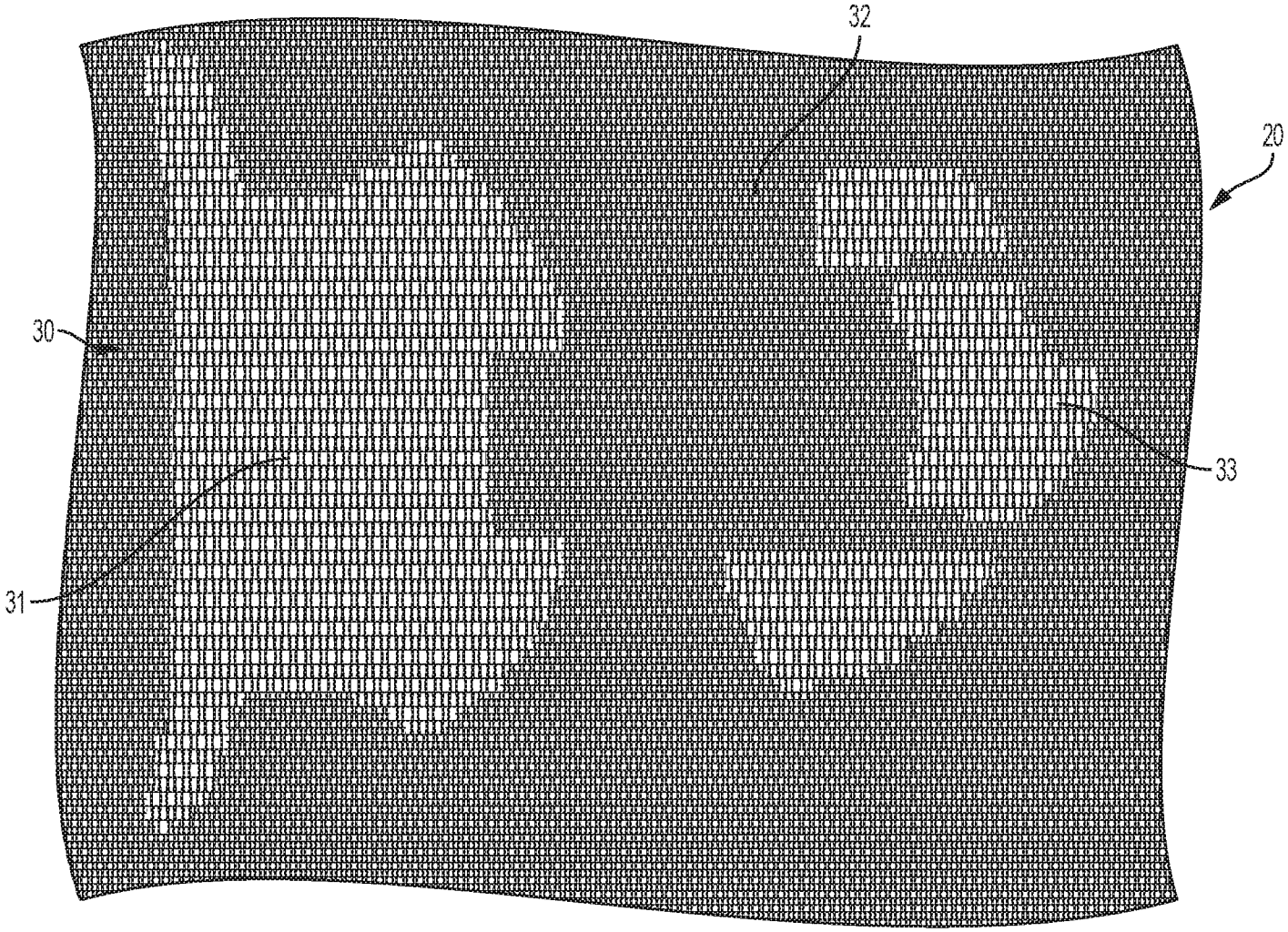
FIG. 6 shows an upper layout according to some embodiments.

In some embodiments, zones 31, 32, and 33 may be used to form a layout for upper 20, as shown, for example, in FIG. 6. The layout for upper 20 is made of a leno woven fabric 30, including a low-stretch zone 31, an intermediate-stretch zone 32, and a high-stretch zone 33. In some embodiments, low-stretch zone 31 may be located in a heel portion of upper 20. In some embodiments, low-stretch zone 31 may constitute a majority of a heel portion of upper 20. In some embodiments, high-stretch zone 33 may be located in a vamp portion of upper 20. In some embodiments, intermediate-stretch zone 32 may be located in any portion of upper 20 that is not low-stretch zone 31 or high-stretch zone 33.

The types of leno weave patterns may be any of the patterns (e.g., engineered jacquard leno weave patterns, custom jacquard leno weave patterns, repeat jacquard leno weave patterns, custom leno weave patterns, repeat leno weave patterns, etc.) described in U.S. application Ser. No. 15/787,178, filed Oct. 18, 2017, the entirety of which is incorporated herein by reference.

Figure 7:
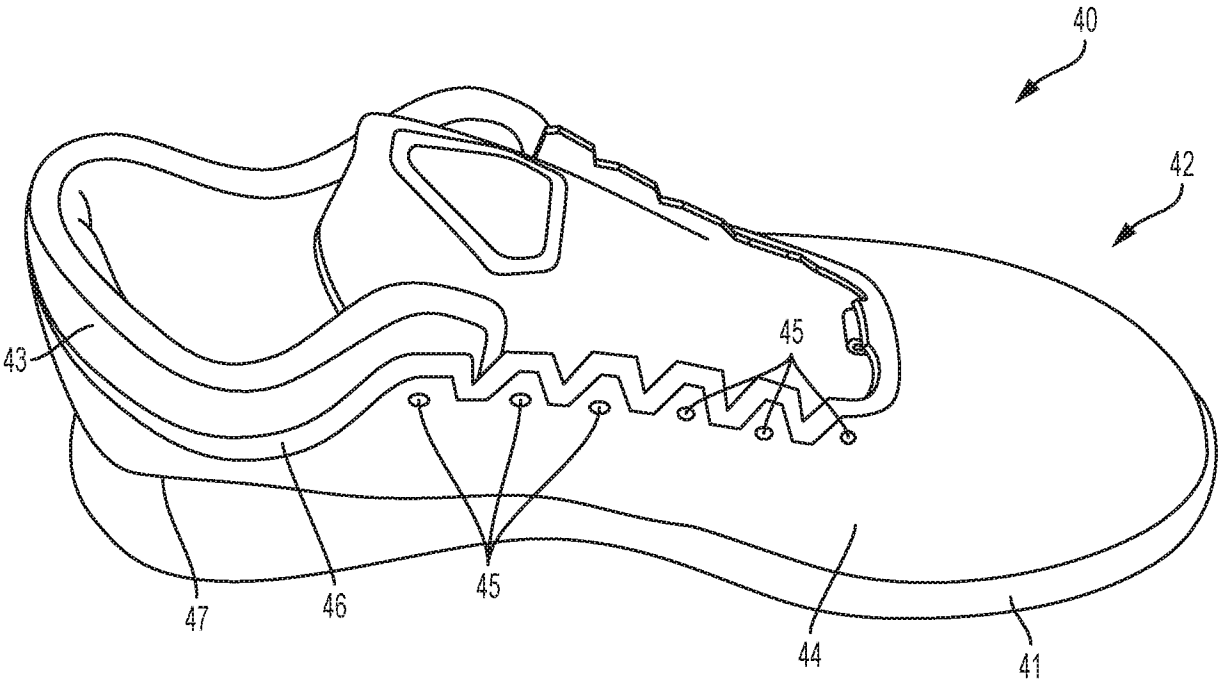
FIG. 7 shows an article of footwear according to some embodiments.

In some embodiments, a leno woven fabric forms an outer cover for an article of footwear, as shown, for example, in FIG. 7. In some embodiments, an article of footwear 40 comprises a sole 41 and an upper 42. Upper 42 may comprise an inner portion 43 and a leno woven fabric 44. In some embodiments, inner portion 43 comprises a bootie, which may be a softer, more elastic material (e.g., spandex) than leno woven fabric 44. In some embodiments, inner portion 43 may completely surround a wearer's foot. In some embodiments, inner portion 43 may only partially surround a wearer's foot (e.g., inner portion 43 may only surround a wearer's heel or only extend from a wearer's heel to a wearer's midfoot). Inner portion 43 may be made of a variety of upper materials.

In some embodiments, leno woven fabric 44 is a single leno woven fabric. In some embodiments, leno woven fabric 44 may have the characteristics of leno woven fabric 30 (e.g., stretch zones). In some embodiments, leno woven fabric 44 is disposed outside of inner portion 43. Thus, leno woven fabric 44 may form an outer layer of upper 42. In some embodiments, leno woven fabric 44 forms an outer cover surrounding inner portion 43. For example, leno woven fabric 44 may form an outer cover for a bootie. In some embodiments, leno woven fabric 44 is attached to inner portion 43. In some embodiments, leno woven fabric 44 is attached to inner portion 43 and/or sole 41 only at or near a bottom portion 47 of leno woven fabric 44. For example, in some embodiments, a top portion 46 of leno woven fabric 44 is not attached to inner portion 43. In some embodiments, leno woven fabric 44 is attached to inner portion 43 in multiple locations (e.g., top portion 46, bottom portion 47, and other locations). In some embodiments, leno woven fabric 44 defines a plurality of apertures 45 configured to receive laces. Threading laces through apertures 45 allows for the lateral and medial sides of leno woven fabric 44 to be pulled together to tighten article of footwear 40 around a wearer's foot.

Figure 8:
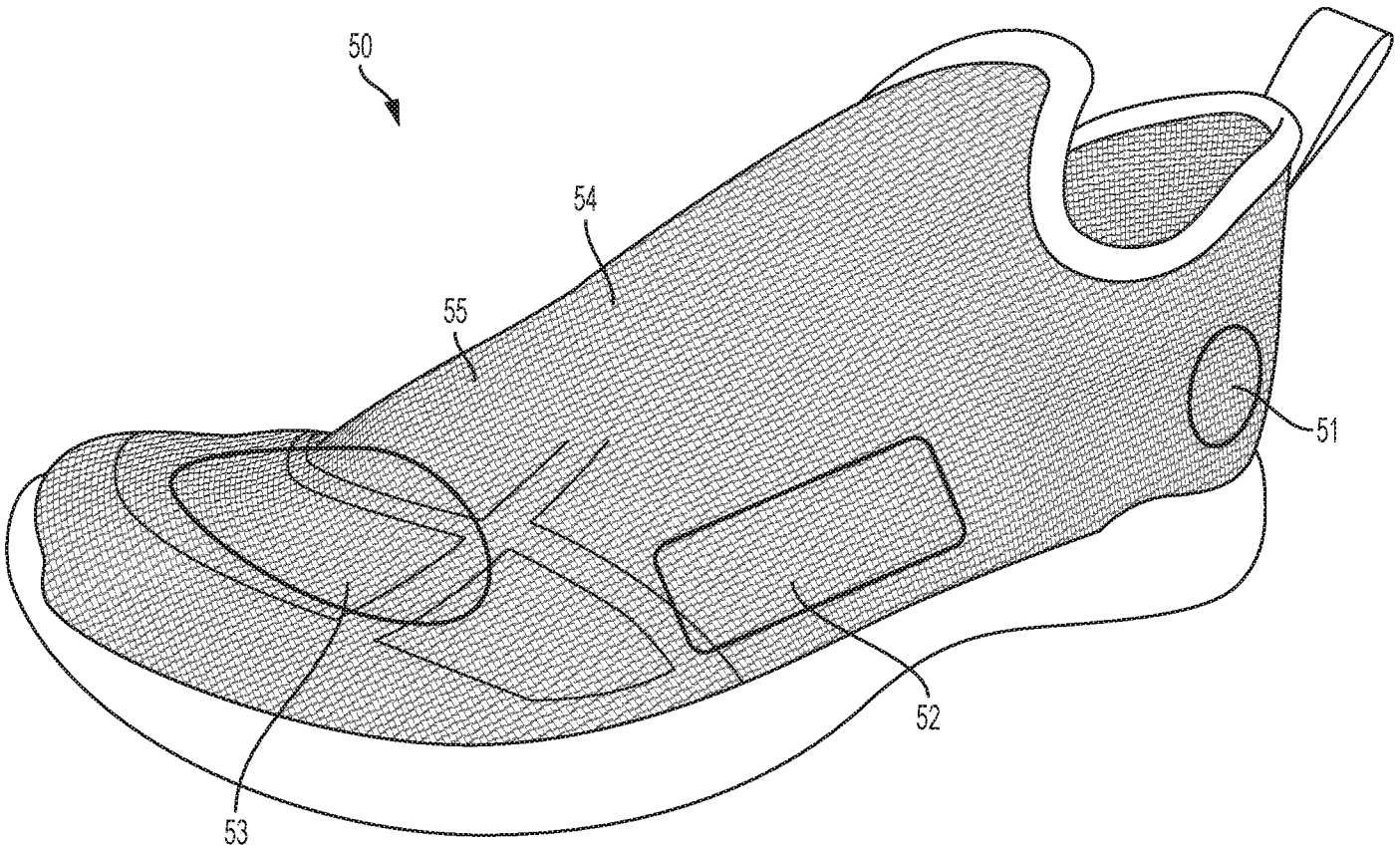
FIG. 8 shows an article of footwear according to some embodiments.

In some embodiments, characteristics other than stretch may differ in a leno woven fabric for an article of footwear. For example, an article of footwear 50, as shown, for example, in FIG. 8, may include an upper 55 that comprises a leno woven fabric 54. Leno woven fabric 54 may include one or more zones 51, 52, 53 having different characteristics. In some embodiments, zones 51, 52, 53 have different degrees of softness (e.g., zone 53 may feel the softest, zone 52 may have an intermediate softness, and zone 51 may feel the least soft). In some embodiments, there may be a gradual transition between the zones 51, 52, 53. In some embodiments, the locations of zones 51, 52, 53 may be the same as zones 31, 32, 33 as discussed above and/or as shown in FIG. 1, 2, or 6. Other configurations are also possible.

In some embodiments, leno woven fabric 54 provides a desired softness due to the material used for the leno woven fabric 54. In some embodiments, leno woven fabric 54 provides a desired softness due to the weaving pattern of the leno woven fabric 54. In some embodiments, leno woven fabric 54 provides a desired softness due to a combination of the weaving pattern and the material of the leno woven fabric 54.

For example, the weft yarns used in leno woven fabric 54 may differ in configuration and/or material, as shown schematically in FIGS. 9-13 (without showing the warp yarns that would be woven with the weft yarns to form a leno woven fabric). In some embodiments, these configurations may be used to provide different levels of softness in zones 51, 52, 53. In some embodiments, the configurations shown in FIGS. 9-13 (and other configurations) may be used together to alter the softness of a particular zone.

In some embodiments, a different level of softness may be provided by introducing weft yarns of different materials. In some embodiments, the weft yarns in a leno woven fabric may be made of a thermoplastic elastomer to provide a hard feel. In some embodiments, the weft yarns may be made of a thermoplastic polyurethane to provide a hard feel. In some embodiments, the weft yarns may be made of a polyester to provide a softer feel. In some embodiments, the weft yarns may be made of chenille to provide an even softer feel. These and other materials may be combined to provide a different level of softness. For example, by varying the amount of thermoplastic elastomer weft yarns and the amount of polyester weft yarns, the level of softness can be changed.

Figure 9:
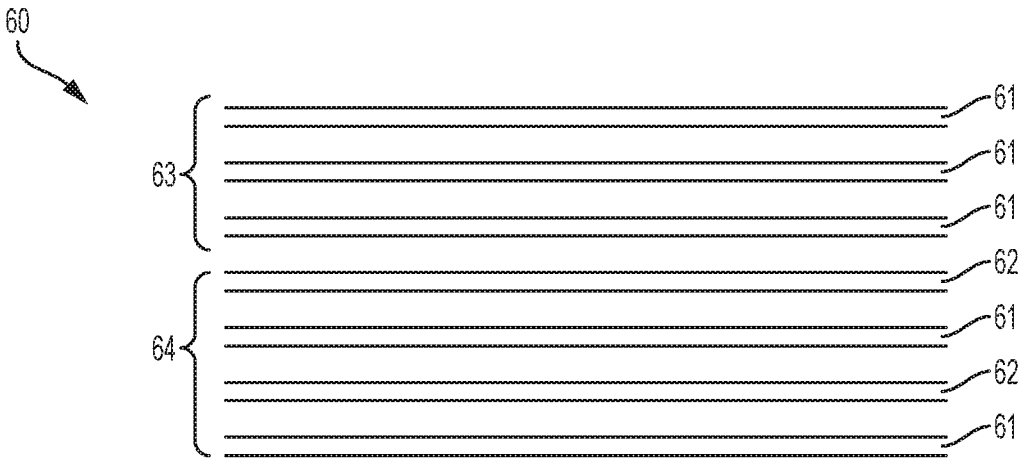
FIG. 9 shows a schematic of weft yarns in a leno woven fabric for an article of footwear according to some embodiments.
Figure 10:
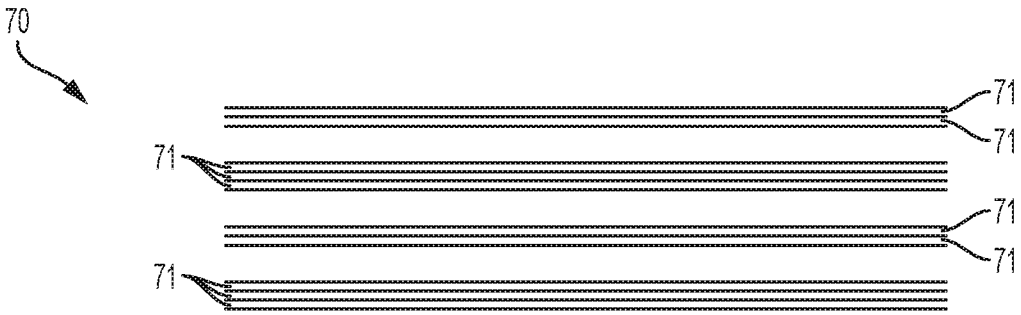
FIG. 10 shows a schematic of weft yarns in a leno woven fabric for an article of footwear according to some embodiments.

In some embodiments, as shown in the configuration 60 of FIG. 9, weft yarns 62 may be a softer material (e.g., polyester or chenille) than weft yarns 61. Thus, a second zone 64 that alternates between weft yarns 61 and weft yarns 62 is softer than a first zone 63 that includes only weft yarns 61. Other configurations of mixing in multiple weft yarns of different material may be used. For example, instead of a ratio of 1:1, other ratios could be used (e.g., 2:1, 3:1, etc.).

Figure 11:
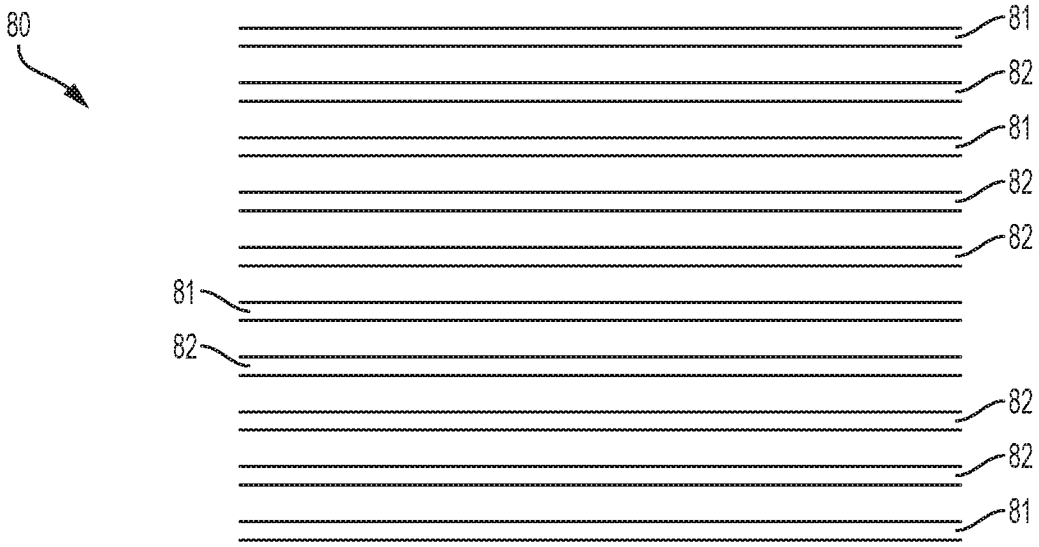
FIG. 11 shows a schematic of weft yarns in a leno woven fabric for an article of footwear according to some embodiments.
Figure 12:
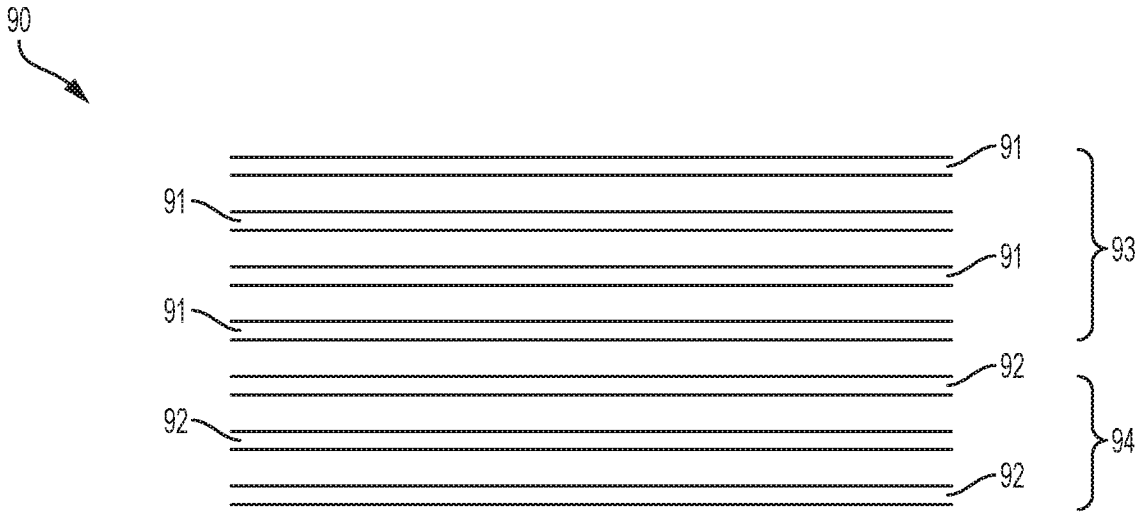
FIG. 12 shows a schematic of weft yarns in a leno woven fabric for an article of footwear according to some embodiments.
Figure 13:
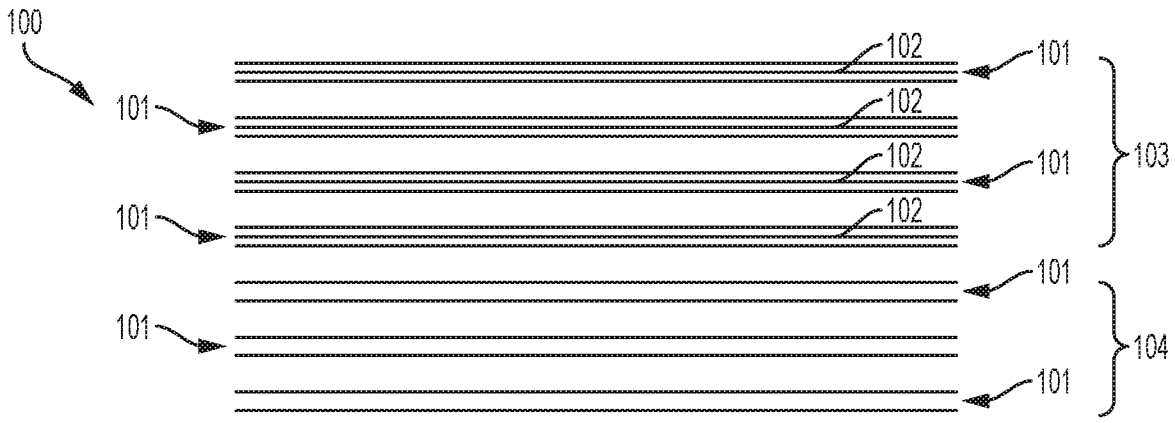
FIG. 13 shows a schematic of weft yarns in a leno woven fabric for an article of footwear according to some embodiments.

In some embodiments, as shown, for example, in FIG. 11, a configuration 80 may be used in which the ratio increases. Weft yarns 82 may be a softer material (e.g., polyester or chenille) than weft yarns 81. Thus, as the ratio of weft yarns 82 to weft yarns 81 increases, the leno woven fabric will gradually transition to a softer feel. In some embodiments, the transition is less gradual. For example, as shown in FIG. 12, a configuration 90 may be used in which a first zone 93 includes only weft yarns 91 and a second zone 94 includes only weft yarns 92. Weft yarns 92 may be a softer material (e.g., polyester or chenille) than weft yarns 91.

In some embodiments, a different level of softness may be provided by using a different number of weft yarns in each set of weft yarns. For example, as shown in the configuration 70 of FIG. 10, weft yarns 71 may be of the same material, but each set of weft yarns 71 alternates between using two weft yarns 71 and three weft yarns 71. Other configurations may also be used (e.g., alternating between more than two amounts, using different number of weft yarns 71, etc.).

In some embodiments, a different level of softness may be provided by introducing one or more strands of weft yarn that are a different material. For example, as shown in the configuration 100 of FIG. 13, a first zone 103 includes a strand 102 within weft yarns 101 and a second zone 104 includes only weft yarns 101. In some embodiments, strand 102 may be harder than weft yarns 101, making second zone 104 softer than first zone 103. In some embodiments, different numbers of strands 102 may be used in various zones to alter the level of softness.

Various embodiments described herein allow for articles of footwear that provide a comfortable and secure fit around the wearer's foot. Further variations of the embodiments described above may also be provided. Moreover, variations in the material, direction, and patterns of the warp and weft yarns may be utilized in some embodiments. For example, while weft yarns have primarily been disclosed as extending in the transverse direction, in some embodiments, the weft yarns may extend in the longitudinal direction. Similarly, while warp yarns have primarily been disclosed as extending in the longitudinal direction, in some embodiments, the warp yarns may extend in the transverse direction. In some embodiments, warp yarns may extend in the longitudinal direction and weft yarns may extend in the transverse direction in one portion of the upper while warp yarns may extend in the transverse direction and weft yarns may extend in the longitudinal direction in another portion of the upper. Other variations are also possible.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear comprising:

a sole; and an upper comprising a leno woven fabric having a continuous leno weave pattern of a plurality of warp yarns extending in a longitudinal direction and a plurality of weft yarns extending in a transverse direction, wherein a weft yarn of the plurality of weft yarns comprises an elastic material;

wherein the leno woven fabric comprises zones having different stretch characteristics.

2. The article of footwear of claim 1, wherein the leno woven fabric comprises a low-stretch zone configured to stretch less than a portion of the upper adjacent to the low-stretch zone.

3. The article of footwear of claim 2, wherein the low-stretch zone is disposed in a heel portion of the upper.

4. The article of footwear of claim 1, wherein the leno woven fabric comprises a high-stretch zone configured to stretch more than a portion of the upper adjacent to the high-stretch zone.

5. The article of footwear of claim 4, wherein the high-stretch zone is disposed in a vamp portion of the upper, and wherein the weft yarn comprising the elastic material is arranged in the high-stretch zone.

6. The article of footwear of claim 1, wherein the leno woven fabric comprises a low-stretch zone, an intermediate-stretch zone, and a high-stretch zone.

7. The article of footwear of claim 6, wherein the intermediate-stretch zone is disposed in a quarter portion of the upper.

8. The article of footwear of claim 6, wherein the intermediate-stretch zone is directly adjacent to the low-stretch zone.

9. The article of footwear of claim 6, wherein the intermediate-stretch zone is directly adjacent to the high-stretch zone.

10. The article of footwear of claim 1, wherein the zones are joined together only by weaving the plurality of warp yarns and the plurality of weft yarns.

11. An upper for an article of footwear, the upper comprising:

a low-stretch zone of leno woven fabric in a heel portion of the upper;

an intermediate-stretch zone of leno woven fabric in a quarter portion of the upper; and a high-stretch zone of leno woven fabric in a vamp portion of the upper, wherein the low-stretch zone, the intermediate-stretch zone, and the high-stretch zone are part of a single leno woven fabric formed by a continuous weaving pattern.

12. The upper of claim 11, wherein the low-stretch zone provides less stretch than the intermediate-stretch zone, and wherein the intermediate stretch zone provides less stretch than the high-stretch zone.

13. The upper of claim 11, wherein the low-stretch zone comprises a reinforcing material configured to constrain the stretchability of the low-stretch zone.

14. The upper of claim 13, wherein the reinforcing material comprises a low-stretch plastic strand.

15. The upper of claim 11, wherein a weaving pattern in the low-stretch zone differs from a weaving pattern in the high-stretch zone.

16. The upper of claim 11, wherein a material in the low-stretch zone differs from a material in the high-stretch zone.

17. The upper of claim 11, wherein the single leno woven fabric forms an outer layer of the upper.

18. The upper of claim 11, wherein the single leno woven fabric forms an outer cover surrounding an inner portion of the upper.

19. The upper of claim 18, wherein the single leno woven fabric defines a plurality of apertures configured to receive laces.

20. The upper of claim 18, wherein a top portion of the single leno woven fabric is not attached to the inner portion of the upper.

* * * * *